US012773604B2

(12) United States Patent
Vergara

(10) Patent No.: US 12,773,604 B2
(45) Date of Patent: Oct. 27, 2026

(54) GOLF PUTTER GRIP

(71) Applicant: SSG International, LLC, Wixom, MI (US)

(72) Inventor: David Vergara, White Lake, MI (US)

(73) Assignee: SSG International, LLC, Wixom, MI (US)

( * ) Notice: Subject to any disclaimer, the term of this patent is extended or adjusted under 35 U.S.C. 154(b) by 930 days.

(21) Appl. No.: 17/991,041

(22) Filed: Nov. 21, 2022

(65) Prior Publication Data

US 2024/0165467 A1 May 23, 2024

(51) Int. Cl.

| | |
|---|---|
| ***A63B 53/14*** | (2015.01) |
| ***A63B 60/10*** | (2015.01) |
| ***A63B 60/12*** | (2015.01) |
| ***A63B 60/14*** | (2015.01) |
| ***A63B 60/16*** | (2015.01) |

(52) U.S. Cl.

CPC ..... *A63B 53/14* (2013.01); *A63B 60/10* (2015.10); *A63B 60/12* (2015.10); *A63B 60/14* (2015.10); *A63B 60/16* (2015.10)

(58) Field of Classification Search

CPC ..... A63B 60/06; A63B 60/10; A63B 60/12; A63B 2071/0694; A63B 53/14

USPC ..... 473/300, 303

See application file for complete search history.

(56) References Cited

U.S. PATENT DOCUMENTS 2,149,911 A * 3/1939 East ..... A63B 60/10 473/201
4,629,191 A * 12/1986 Mancuso ..... A63B 60/10 473/203
5,427,376 A * 6/1995 Cummings ..... A63B 69/3632 473/238
5,584,482 A * 12/1996 Huang ..... A63B 53/14 473/301
6,022,278 A * 2/2000 Vela ..... A63B 60/10 473/238
6,656,054 B2 * 12/2003 Ulrich ..... A63B 53/14 473/549
6,783,463 B2 * 8/2004 Zichmanis ..... A63B 60/20 473/204
6,908,400 B2 * 6/2005 Chu ..... A63B 60/14 473/303
7,458,903 B2 * 12/2008 Wang ..... A63B 53/14 473/300
7,566,375 B2 * 7/2009 Huang ..... A63B 60/00 156/247

(Continued)

FOREIGN PATENT DOCUMENTS

DE 102011120061 A1 3/2012

*Primary Examiner* — Nicholas J. Weiss

(74) *Attorney, Agent, or Firm* — WARNER NORCROSS + JUDD LLP

(57) ABSTRACT

An improved putter grip is provided. The putter grip includes an alignment strip oriented lengthwise on the front-facing surface of the putter grip, the alignment strip widening toward the lower end of the putter grip for placement of the golfer's thumbs. The putter grip includes a polygonal cross-sectional area that increases toward the upper end of the elongated handle, and the butt end is rearwardly offset relative to the longitudinal axis of a shaft opening. In addition, the rear-facing surface of the putter grip is outwardly concave when viewed from a side direction to provide an ergonomic gripping surface for the golfer's non-dominant hand.

16 Claims, 8 Drawing Sheets

(56) References Cited

U.S. PATENT DOCUMENTS

| | | | | |
|---|---|---|---|---|
| 7,862,445 | B2 * | 1/2011 | Huang | A63B 60/54 156/314 |
| 7,931,541 | B2 * | 4/2011 | Rhodes | A63B 69/3632 473/409 |
| 8,888,606 | B2 * | 11/2014 | Boccieri | A63B 60/16 473/297 |
| 9,005,045 | B2 * | 4/2015 | Dingman | A63B 53/007 473/204 |
| 9,463,363 | B2 * | 10/2016 | Dingman | A63B 60/24 |
| D774,612 | S * | 12/2016 | Dingman | D21/756 |
| D794,147 | S * | 8/2017 | Davis | D21/756 |
| 10,052,538 | B2 * | 8/2018 | Davis | A63B 60/10 |
| 10,143,902 | B1 * | 12/2018 | Cavill | A63B 53/14 |
| 10,500,455 | B1 * | 12/2019 | Cavill | A63B 53/007 |
| 10,682,557 | B2 * | 6/2020 | Ambrose | A63B 60/08 |
| 10,716,981 | B1 * | 7/2020 | Biafore, Jr. | A63B 60/06 |
| D896,331 | S * | 9/2020 | Biafore, Jr. | D21/756 |
| 10,806,974 | B1 * | 10/2020 | Biafore, Jr. | A63B 60/14 |
| D950,659 | S * | 5/2022 | Rife | D21/756 |
| 11,628,347 | B2 * | 4/2023 | Ambrose | A63B 53/007 473/226 |
| D1,012,215 | S * | 1/2024 | Dingman | D21/756 |
| D1,022,094 | S * | 4/2024 | Kirtley | D21/756 |
| D1,022,096 | S * | 4/2024 | Kirtley | D21/756 |
| D1,028,148 | S * | 5/2024 | Serrano | D21/756 |
| 2003/0176234 | A1 * | 9/2003 | Sheets | A63B 60/14 473/300 |
| 2007/0259732 | A1 * | 11/2007 | Billings | A63B 60/00 473/282 |
| 2015/0209626 | A1 * | 7/2015 | Klein | A63B 53/007 473/300 |
| 2022/0118320 | A1 * | 4/2022 | Bradford | A63B 47/02 |
| 2023/0191212 | A1 * | 6/2023 | Cavill | A63B 53/14 473/300 |
| 2025/0032868 | A1 * | 1/2025 | Bradford | A63B 60/16 |

* cited by examiner

GOLF PUTTER GRIP

FIELD OF THE INVENTION

The present invention generally relates to golf club grips and, more specifically, to pistol grips for putters.

BACKGROUND OF THE INVENTION

Various styles of golf club grips are known in the art. Putter grips in particular are historically more complex than swing grips and can include various profiles. Examples include putter grips having a circular profile, an oval profile, or a square profile. Putter grips having a pistol profile, also referred to as pistol grips, include a non-circular cross-section in which the cross-sectional area increases toward the butt-end and the axis of the grip tilts toward the player.

Pistol grips are increasingly common among professional and amateur golfers and provide an enlarged grip surface for the golfer's non-dominant hand. However, there remains a continued need for an improved putter grip with an ergonomically designed shape. In particular, there remains a continued need for a putter grip that promotes a natural and more consistent putting stroke while remaining compliant with equipment guidelines from the relevant governing bodies.

SUMMARY OF THE INVENTION

An improved putter grip is provided. In one embodiment, the putter grip is configured as a pistol grip having a polygonal cross-section, for example an irregular pentagon. The cross-sectional area of the putter grip increases toward the upper end of the putter grip, and the upper end is rearwardly offset relative to the longitudinal axis of a shaft opening. The front-facing surface of the putter grip includes an alignment strip oriented in a lengthwise direction, the alignment strip widening toward the lower end of the putter grip for placement of the golfer's thumbs. The rear-facing surface of the putter grip is outwardly concave when viewed from a side direction to provide an ergonomic gripping surface for the golfer's non-dominant hand.

In one embodiment, the putter grip includes a textured grip sleeve surrounding a rigid underlisting. The textured grip sleeve includes a lower durometer than the rigid underlisting. By non-limiting example, the textured grip sleeve can be formed from polyurethane (PU) or thermoplastic polyurethane (TPU), and the rigid underlisting can be formed from thermoplastic rubber (TPR) or ethylene-vinyl acetate (EVA). Other materials can be used in other embodiments. In still other embodiments, the textured grip sleeve and the underlisting are integrally formed with one another and comprise a unitary putter grip.

In another embodiment, the polygonal cross-section is an irregular pentagon. The dimensions of the irregular pentagon vary as a function of location along the length of the putter grip. For example, the base of the irregular pentagon narrows toward the upper end of the putter grip, and the opposing side edges of the irregular pentagon lengthen and remain parallel to each other. The opposing side surfaces of the putter grip remain parallel to each other along their entire length, such that the putter grip does not exhibit any taper (converging or diverging) when viewed from the front or the rear. When viewed from the side, the alignment strip is slightly outwardly convex. The angled edges of the irregular pentagon converge at a rounded spine that extends in a lengthwise direction along the rear-facing surface of the putter grip. Each edge of the irregular pentagon is joined to the two adjacent edges by rounded or beveled corners. In other embodiments, the putter grip can include other polygonal cross-sections (e.g., trapezoidal, rectangular, hexagonal, heptagonal, octagonal) or non-polygonal cross-sections (e.g., circular or elliptical).

In still another embodiment, the front-facing surface of the putter grip includes an alignment strip that is oriented in a lengthwise direction. The alignment strip gradually widens toward the lower end of the putter grip, such that the ratio of the width of the alignment strip at the lower end of the putter grip relative to the width of the alignment strip at the upper end of the putter grip is at least 2:1. The alignment strip comprises the base of the irregular pentagon when viewed in cross-section and is planar in a side-to-side direction. For example, the alignment strip can include an apex that is nearer to the upper end of the putter grip than to the lower end of the putter grip. Further optionally, the alignment strip can include an apex that is located between 30% and 40% of the overall length of the putter grip, as measured from the upper end of the putter grip.

In yet another embodiment, the rear-facing surface of the putter grip is outwardly concave when viewed from a side direction to provide an ergonomic gripping surface for the golfer's non-dominant hand. The outwardly concave portion is defined by an arc of a circle having a radius of at least 13 inches, further optionally between 13 inches and 15 inches, inclusive. The outwardly concave portion defines a length that is less than the overall length of the putter grip. In one embodiment, the ratio of the length of the outwardly concave portion relative to the total length of the putter grip is between 1:3 and 1:2, inclusive. Stated differently, the length of the outwardly concave portion is between 33% and 50% of the total length of the putter grip. In addition, the putter grip defines a front-to-back width at the upper end of the putter grip that is at least twice the front-to-back width at the lower end of the putter grip.

The putter grip can be assembled to a golf club shaft by inserting the golf club shaft into an opening in the underlisting. The putter grip is rotated so that the putter grip's enlarged heel is aligned with the heel of the club head. In this position, the alignment strip aligns with the toe of the putter head, while the spine aligns with the heel of the putter head. The putter grip is then held as a conventional pistol grip, with the enlarged heel closest to the golfer.

These and other features of the invention will be more fully understood and appreciated by reference to the description of the embodiments and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. In addition, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENT

Figure 1:
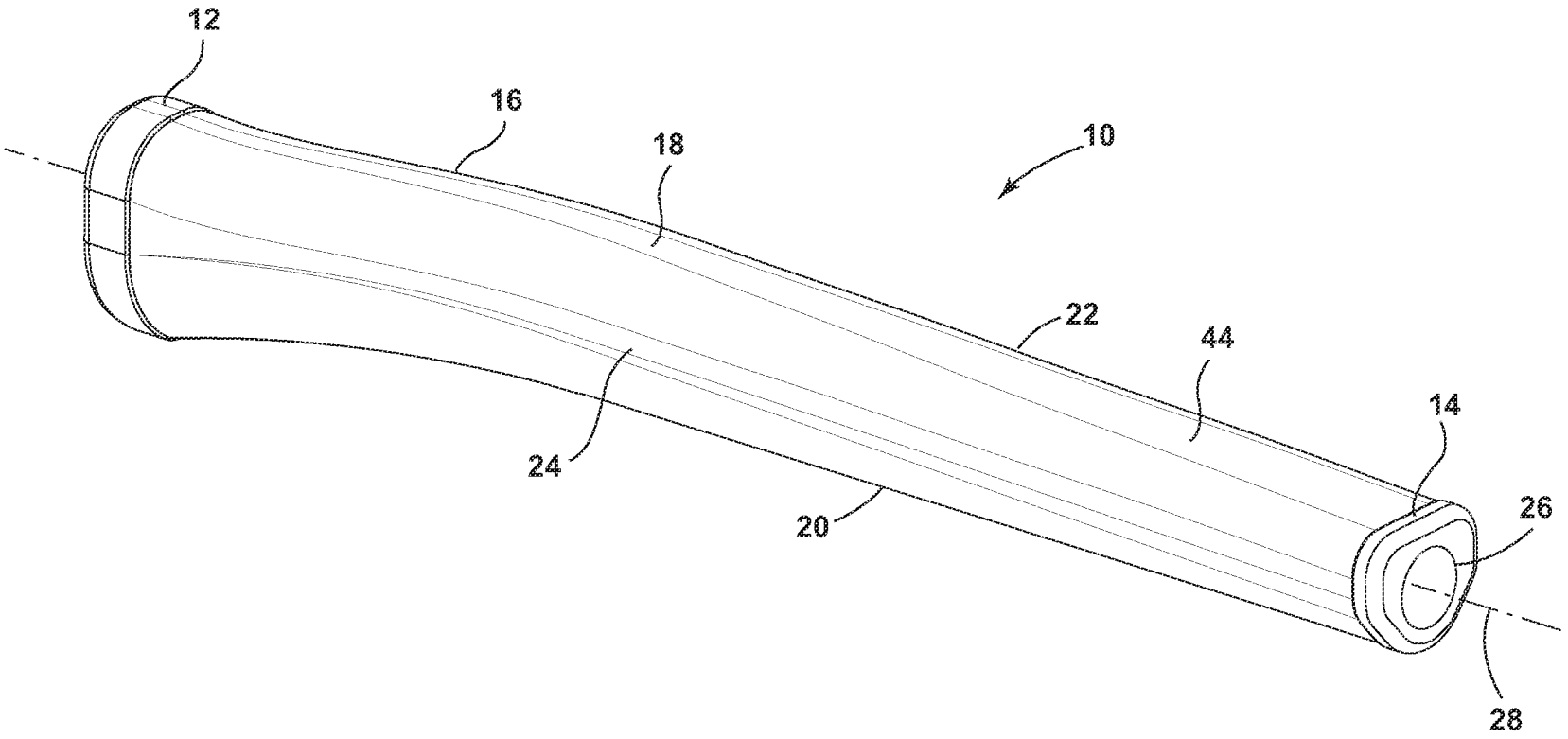
FIG. 1 is a first perspective view of a putter grip in accordance with one embodiment of the present invention.

Referring to FIGS. 1-8, a putter grip in accordance with one embodiment is illustrated and generally designated 10. As discussed below, the putter grip generally includes a polygonal cross-section and an enlarged heel that is rearwardly offset relative to the longitudinal axis of a shaft opening. The putter grip 10 also includes an alignment strip oriented lengthwise on the front-facing surface of the elongated handle, the alignment strip widening toward the lower end of the putter grip for placement of the golfer's thumbs. The rear-facing surface of the putter grip is outwardly concave when viewed from a side direction to provide an ergonomic gripping surface for the golfer's non-dominant hand. Each such feature of the putter grip is discussed below. As shown in FIG. 1, the exterior of the putter grip 10 includes an upper end 12, a lower end 14, and a body 16 therebetween. The body 16 includes a front-facing surface 18, a rear-facing surface 20, a left side surface 22, and a right side surface 24. The lower end 14 includes a shaft opening 26 defining a longitudinal axis 28, and the upper end 12 includes an internally threaded port 30 (visible in FIG. 3) for a removable grip cap. The left side surface 22 and the right side surface 24 fully mirror each other, while in other embodiments the left side surface 22 and the right side surface 24 diverge from each other nearer to the upper end 12.

Figure 2:
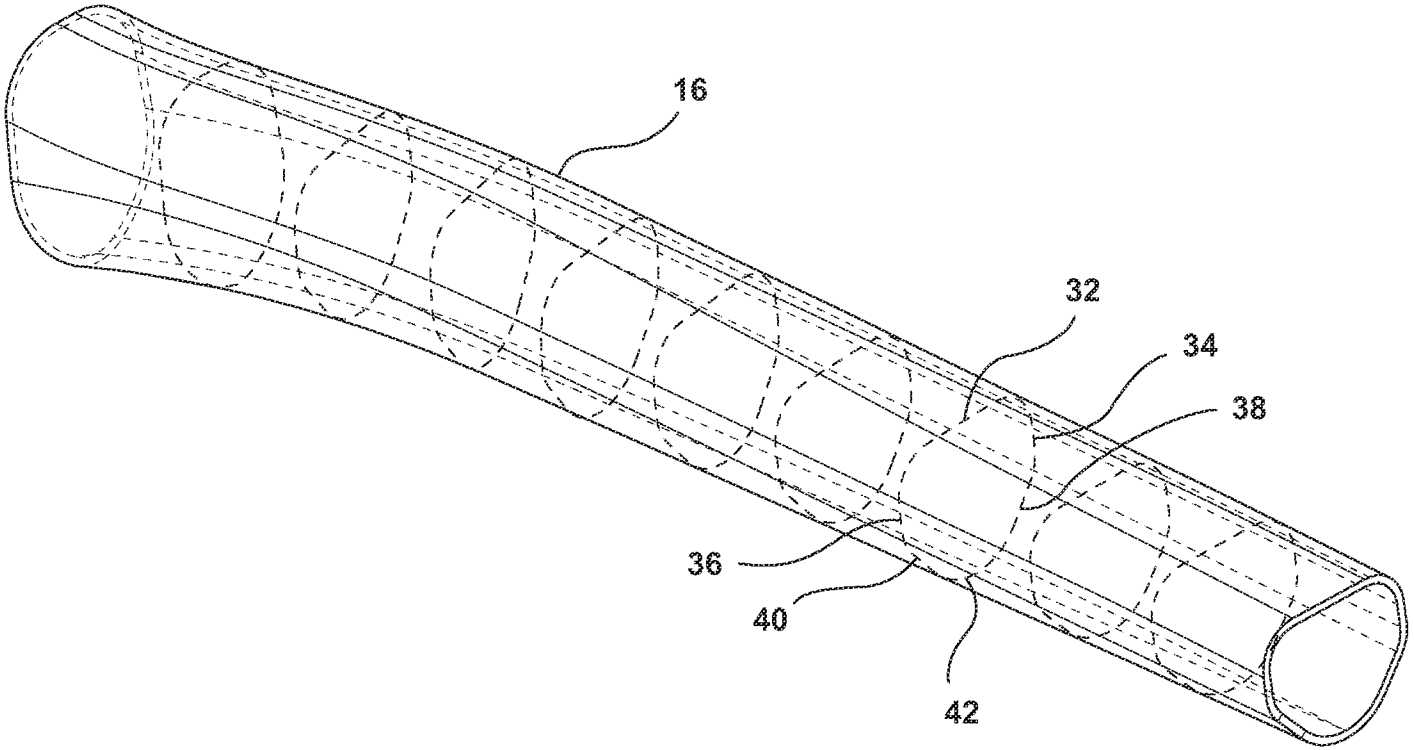
FIG. 2 illustrates the exterior of the putter grip of FIG. 1 as having a cross-sectional shape that changes as the putter grip extends along its length.
Figure 3:
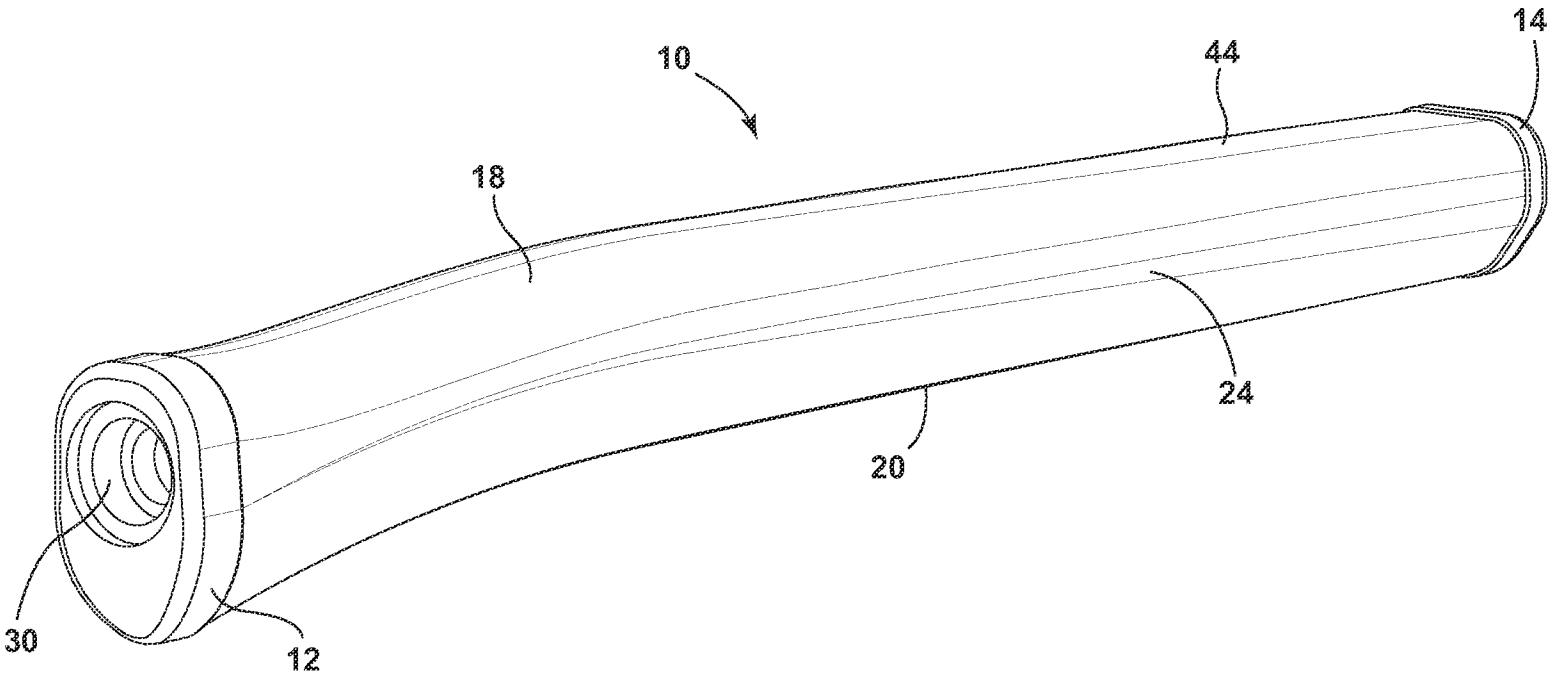
FIG. 3 includes a second perspective view of the putter grip of FIG. 1 illustrating an opening for a grip cap or other accessory.

As shown in FIG. 2, the body 16 includes a polygonal cross-section that increases in cross-sectional area towards the upper end 12 of the putter grip 10. The polygonal cross-section is an irregular pentagon in the illustrated embodiment, however the body 16 can include other polygonal cross-sections (e.g., trapezoidal, rectangular, hexagonal, heptagonal, octagonal) or non-polygonal cross-sections (e.g., circular or elliptical) in other embodiments. As used herein, a "polygonal cross-section" includes polygonal cross-sections having rounded corners, beveled corners, and/or square corners. For example, the irregular pentagon shown in broken lines in FIG. 2 includes a base 32 that intersects left and right side edges 34, 36 at rounded corners. The side edges 34, 36 intersect left and right angled edges 38, 40 at rounded corners. The left and right angled edges 38, 40 converge at a rounded spine 42 which extends lengthwise along the rear-facing surface 20 of the putter grip 10. The dimensions of the cross-section vary as a function of location along the longitudinal axis 28, such that the base 32 of the irregular pentagon narrows toward the upper end 12 of the putter grip 10, while the opposing side edges 34, 36 of the irregular pentagon lengthen (and remain parallel to each other). Because the opposing side surfaces 22, 24 remain parallel to each other along their entire length, the putter grip 10 does not exhibit any taper (converging or diverging) when viewed from the front or the rear. In other embodiments, the opposing side surfaces 22, 24 are angled toward or away from each other, such that the putter grip 10 includes a taper in the side-to-side direction. In still other embodiments, the shape of the cross-section varies as a function of location along the longitudinal axis 28, such that the putter grip 10 can include a first cross-sectional shape along one portion thereof and a second cross-sectional shape along another portion thereof (e.g., a first polygonal shape along a first portion of the putter grip and a second polygonal shape along a second portion of the putter grip).

Figure 4:
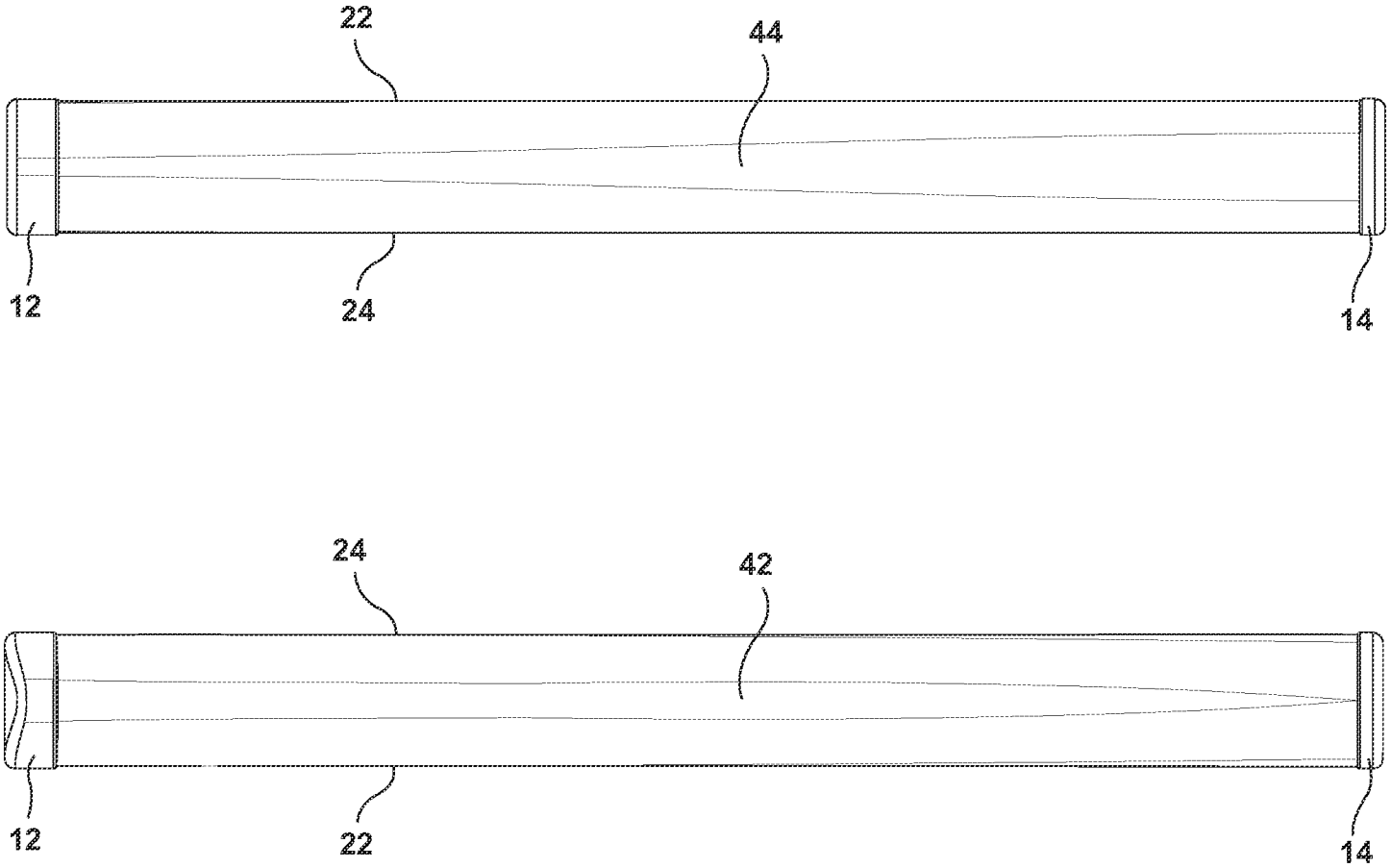
FIG. 4 includes a front view and a rear view of the putter grip of FIG. 1 illustrating an alignment strip and a spine, respectively.
Figure 5:
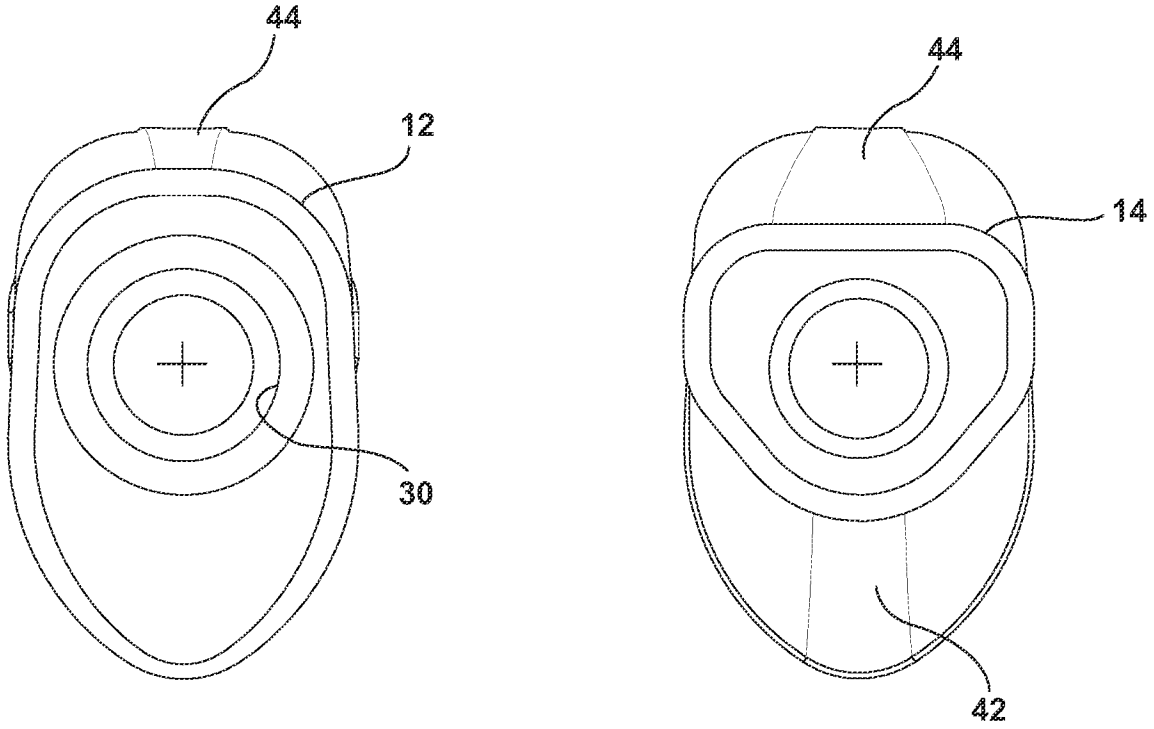
FIG. 5 includes a top view and a bottom view of the putter grip of FIG. 1 illustrating an opening for a grip cap and an opening for a putter shaft, respectively.
Figure 6:
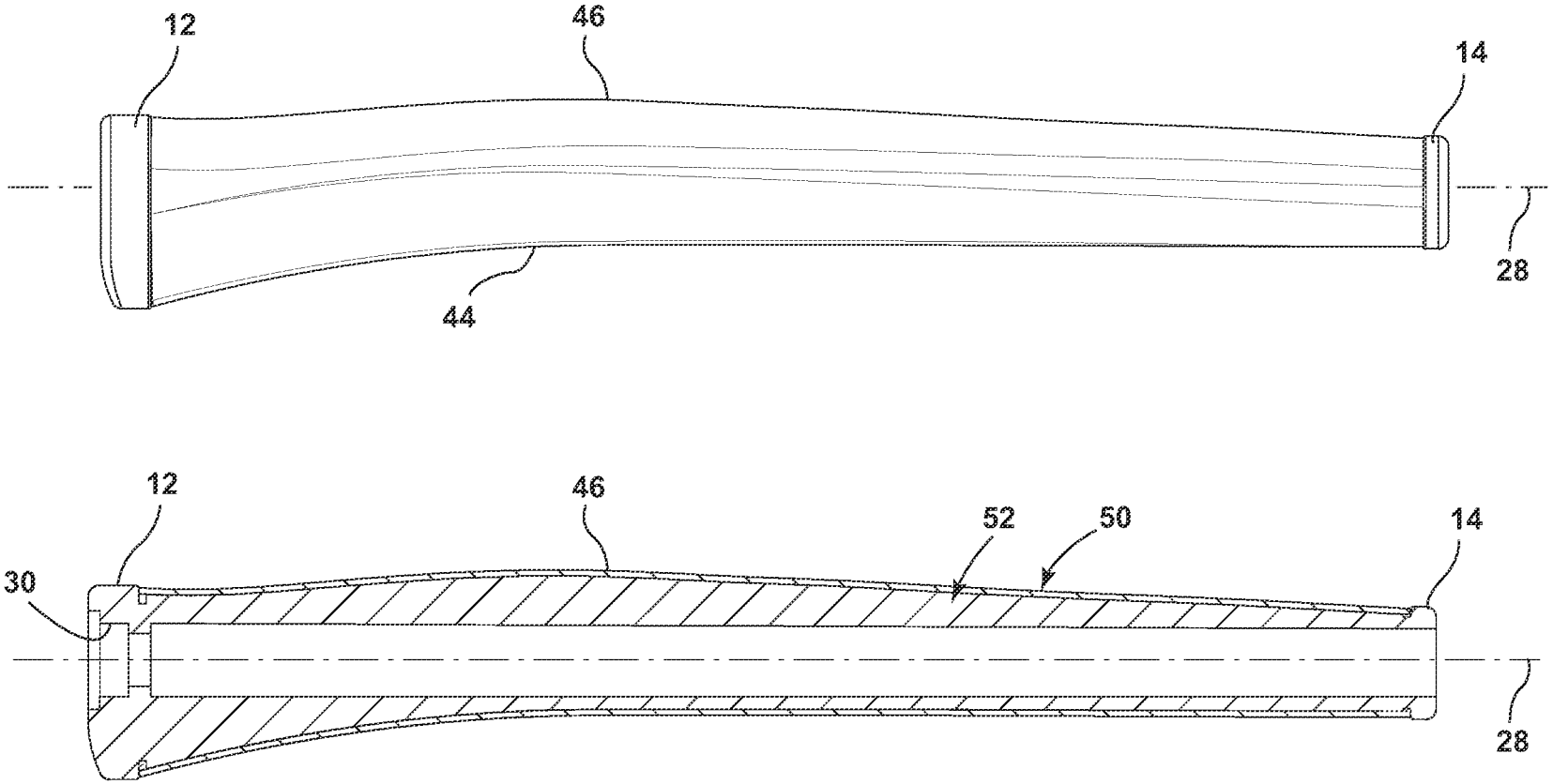
FIG. 6 illustrates a side view and a cross-sectional view of the putter grip of FIG. 1 as having a rearwardly-offset heel or butt end.

As shown in FIG. 4, the front-facing surface 18 of the putter grip 10 includes an alignment strip 44 that is oriented lengthwise between the upper end 12 and the lower end 14. The alignment strip 44 gradually (e.g., linearly) widens toward the lower end 14, such that the ratio of the width of the alignment strip 44 at the lower end 14 relative to the lower end 12 is at least 2:1. The alignment strip 44 comprises the base 32 of the irregular pentagon when viewed in cross-section and is planar in a side-to-side direction. When viewed from the side as shown in FIG. 6, the alignment strip 44 is slightly outwardly convex. For example, the alignment strip 44 can include an apex 46 that is nearer to the upper end 12 than to the lower end 14. Further optionally, the alignment strip 44 can include an apex 46 that is located between 30% and 40% of the overall length of the putter grip 10, as measured from the upper end 12 of the putter grip 10.

Figure 8:
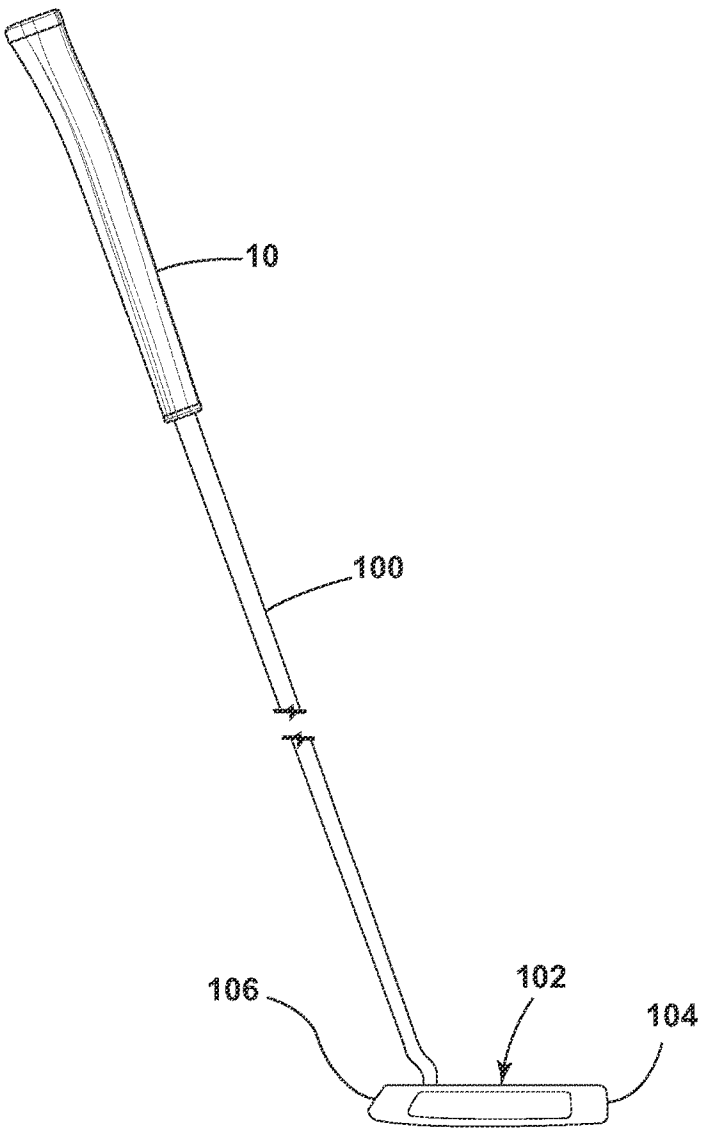
FIG. 8 illustrates the putter grip of FIG. 1 joined to a putter shaft, such that the alignment strip is aligned with the toe and the spine is aligned with the heel of the putter head.

As also shown in cross-section in FIG. 6, the putter grip 10 includes a textured grip sleeve 50 surrounding a rigid underlisting 52. The textured grip sleeve 50, for example PU or TPU, generally includes a lower durometer than the rigid underlisting 52, which is optionally TPR molded or EVA. In other embodiments, the textured grip surface 50 and the underlisting 52 are integrally formed with one another and comprise a unitary putter grip. Collectively, the grip sleeve 50 and the underlisting 52 comprise an elongated handle for a golf club, for example a putter 100, which is shown in FIG. 8 by example.

Figure 7:
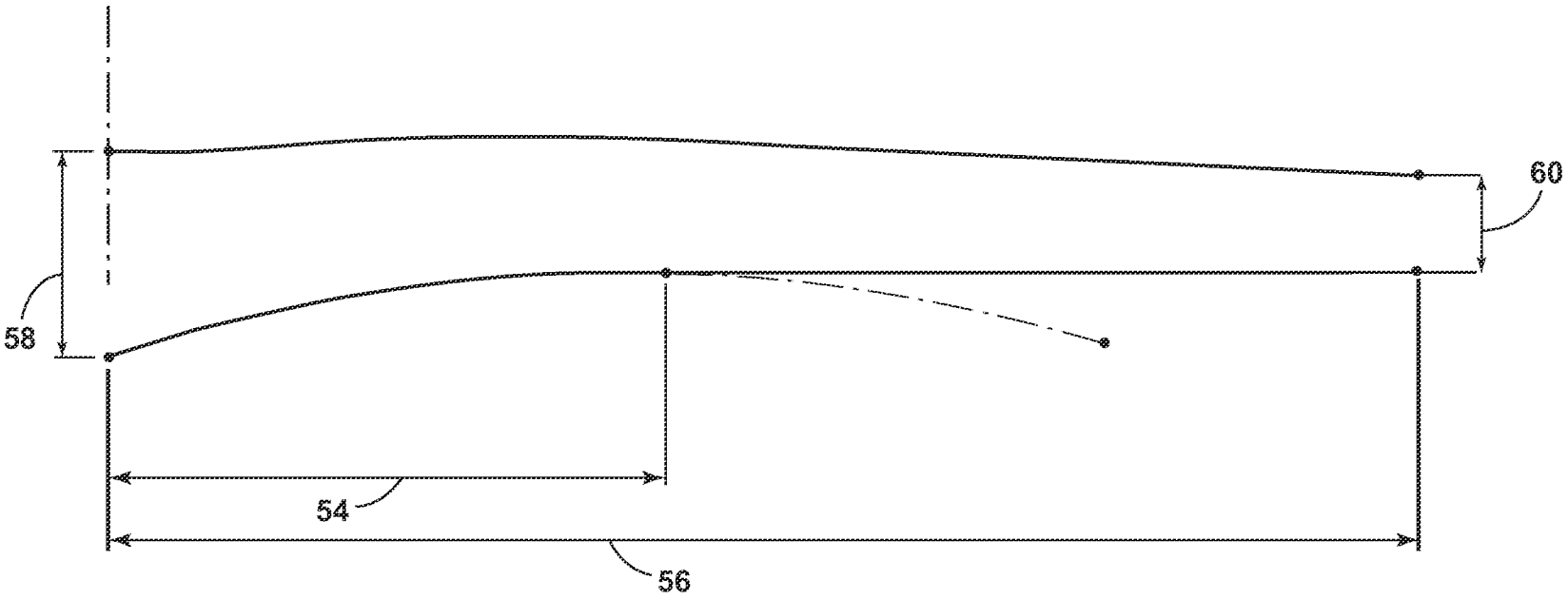
FIG. 7 illustrates an outwardly concave portion of the putter grip when viewed from the side as having a radius of curvature.

As shown in FIG. 7, the rear-facing surface 20 of the putter grip 10 is outwardly concave when viewed from a side direction to provide an ergonomic gripping surface for the golfer's non-dominant hand. In the illustrated embodiment, the outwardly concave portion 54 defines a radius of curvature of at least 13 inches, further optionally between 13 inches and 15 inches, inclusive. The outwardly concave portion 54 defines a length (parallel to the longitudinal axis) that is less than the overall length of the putter grip 10. In one embodiment, the ratio of the length of the outwardly concave portion 54 relative to the total length 56 of the putter grip is between 1:3 and 1:2. Stated differently, the length of the outwardly concave portion 54 is between 33% and 50% of the total length 56 of the putter grip 10. In addition, the putter grip 10 defines a first front-to-back width 58 proximate the upper end 12 and a second front-to-back width 60 proximate the lower end 14, wherein a ratio of the first front-to-back width 58 relative to the second front-to-back width 60 is at least 2:1, for example at least 2.5:1.

To reiterate, the outwardly concave portion 54 of the rear-facing surface 20 adheres to an arc of a circle when viewed from the side. The arc of the circle includes a radius of at least 13 inches, further optionally between 13 inches and 15 inches, inclusive. The entirety of the rear-facing surface 20 (extending from the upper end 12 to the lower end 14) can adhere to a polynomial function (e.g., a quadratic function or a cubic function) using an extrapolation curve having an origin (0,0) at the lowermost portion of the gripping surface. For example, the extrapolation curve can include the following sixth order polynomial, where the coefficients are defined below:

$$y=a\cdot x^6-b\cdot x^5+c\cdot x^4-d\cdot x^3-e\cdot x^2+f\cdot x+g$$

$a<0.0001$
$0.0001<b<0.001$
$0.001<c<0.01$
$0.01<d<0.1$
$0.001<e<0.01$
$0.1<f<1$
$0.001<g<0.01$

For example, the coefficients for the higher order polynomial above can include the following: {a=0.00001; b=0.0004; c=0.0048; d=0.0207; e=0.0017; f=0.2485; g=0.0014} The above coefficients and polynomial are not intended to be limiting, and the rear-facing surface 20 can adhere to other polynomial functions using an extrapolation curve in other embodiments.

As noted above, the putter grip 10 includes an underlisting 52, the underlisting 52 having an upper end 12 (upper peripheral flange) and a lower end 14 (lower peripheral flange), with the textured grip sleeve 50 extending therebetween. The putter grip 10 can be assembled to a putter 100 by inserting the golf club shaft into an opening 26 in the underlisting 52. The putter grip 10 is rotated so that the alignment strip 44 is aligned with the toe 104 of the putter head 102, while the spine 42 is aligned with the heel 106 of the putter head 102. The putter grip 10 is then held as a conventional pistol grip, with the enlarged butt end being closest to the golfer.

The above description is that of current embodiments of the invention. While certain features of the putter grip are functional, they can be implemented in different aesthetic configurations. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The invention claimed is:

1. A putter grip comprising:

an elongated handle including an upper end cap, a lower end cap, and a body therebetween, the lower end cap including a shaft opening defining a longitudinal axis;

wherein the body of the elongated handle includes a right side surface, a left side surface, a front-facing surface, and a rear-facing surface;

wherein the body of the elongated handle defines a polygonal cross-section having a cross-sectional area that increases toward the upper end cap of the elongated handle, the polygonal cross-section defining an irregular pentagon having a base, left and right side edges, left and right angled edges, and rounded corners; and wherein the front-facing surface includes an alignment strip that is oriented lengthwise between the upper end cap and the lower end cap of the elongated handle and that extends continuously from the upper end cap to the lower end cap, the alignment strip comprising the base of the polygonal cross-section, the alignment strip being planar in a side-to-side direction along its length and defining a width that widens toward the lower end of the elongated handle, the width of the alignment strip at the lower end cap and the width of the alignment strip at the upper end cap defining a ratio of at least 2:1, the alignment strip defining an inflection point when viewed from a side direction that is nearer to the upper end cap than the lower end cap.

2. The putter grip of claim 1, wherein the rear-facing surface is rearwardly offset proximate the upper end cap of the elongated handle.

3. The putter grip of claim 1, wherein the rear-facing surface is outwardly concave along a portion thereof relative to the longitudinal axis when viewed from a side direction, the outwardly concave portion of the rear-facing surface defining a radius of curvature of at least 13 inches.

4. The putter grip of claim 3, wherein the outwardly concave portion of the rear-facing surface defines a first length, and wherein the elongated handle defines a second length, wherein a ratio of the first length relative to the second length being between 1:2 and 1:3, the first length and the second length being parallel to the longitudinal axis.

5. The putter grip of claim 3, wherein the outwardly concave portion of the rear-facing surface defines a first length, and wherein the elongated handle defines a second length, wherein the first length is at least 33% of the second length, the first length and the second length being parallel to the longitudinal axis.

6. The putter grip of claim 3, wherein the outwardly concave portion of the rear-facing surface defines a first length, and wherein the elongated handle defines a second length, wherein the first length is between 40% and 45% of the second length, inclusive, the first length and the second length being parallel to the longitudinal axis.

7. The putter grip of claim 3, wherein the elongated handle defines a first front-to-back width proximate the upper end cap and a second front-to-back width proximate the lower end cap, wherein a ratio of the first front-to-back width relative to the second front-to-back width is at least 2:1.

8. The putter grip of claim 3, wherein the upper end cap includes an internally threaded opening for receiving a threaded grip cap.

9. The putter grip of claim 1, wherein the body of the elongated handle includes a textured grip sleeve surrounding a rigid underlisting.

10. A putter grip comprising:

an elongated handle including an upper end cap, a lower end cap, and a body therebetween, the lower end cap including a shaft opening defining a longitudinal axis;

wherein the body of the elongated handle includes a right side surface, a left side surface, a front-facing surface, and a rear-facing surface;

wherein the body of the elongated handle defines a cross-sectional area that increases toward the upper end of the elongated handle, the polygonal cross-section defining an irregular pentagon having a base, left and right side edges, left and right angled edges, and rounded corners;

wherein the rear-facing surface is rearwardly offset relative to the longitudinal axis proximate the upper end cap of the elongated handle;

wherein the rear-facing surface is outwardly concave along a portion thereof relative to the longitudinal axis when viewed from a side direction, the outwardly concave portion of the rear-facing surface defining a radius of curvature of at least 13 inches;

wherein the front-facing surface includes an alignment strip that extends continuously from the upper end cap to the lower end cap, the alignment strip comprising the base of the polygonal cross-section, the alignment strip being planar in a side-to-side direction along its length and defining a width that widens toward the lower end of the elongated handle, the width of the alignment strip at the lower end cap and the width of the alignment strip at the upper end cap defining a ratio of at least 2:1, the alignment strip defining an inflection point when viewed from a side direction that is nearer to the upper end cap than the lower end cap.

11. The putter grip of claim 10, wherein the outwardly concave portion of the rear-facing surface defines a first length, and wherein the elongated handle defines a second length, wherein a ratio of the first length relative to the second length is between 1:2 and 1:3.

12. The putter grip of claim 10, wherein the outwardly concave portion of the rear-facing surface defines a first length, and wherein the elongated handle defines a second length, wherein the first length is at least 33% of the second length, the first length and the second length being parallel to the longitudinal axis.

13. The putter grip of claim 10, wherein the outwardly concave portion of the rear-facing surface defines a first length, and wherein the elongated handle defines a second length, wherein the first length is between 40% and 45% of the second length, inclusive, the first length and the second length being parallel to the longitudinal axis.

14. The putter grip of claim 10, wherein the elongated handle defines a first front-to-back width proximate the upper end cap and a second front-to-back width proximate the lower end cap, wherein a ratio of the first front-to-back width relative to the second front-to-back width is at least 2:1.

15. The putter grip of claim 10, wherein the upper end cap includes an internally threaded opening for receiving a threaded grip cap.

16. The putter grip of claim 10, wherein the elongated handle includes a textured grip sleeve surrounding a rigid underlisting.

* * * * *